US006223566B1

(12) United States Patent
Jamison

(10) Patent No.: US 6,223,566 B1
(45) Date of Patent: May 1, 2001

(54) UNIVERSAL GUN LOCK INSERTED THROUGH MUZZLE

(76) Inventor: Marc L. Jamison, 416 Pizza Lido, Newport Beach, CA (US) 92627

( * ) Notice: Subject to any disclaimer, the term of this patent is extended or adjusted under 35 U.S.C. 154(b) by 0 days.

(21) Appl. No.: 09/432,372

(22) Filed: Nov. 1, 1999

(51) Int. Cl.[7] ..... F41A 17/00
(52) U.S. Cl. ..... 70/11
(58) Field of Search ..... 42/70.11, 70.01

(56) References Cited

U.S. PATENT DOCUMENTS 4,512,099 * 4/1985 Mathew .
4,908,971 * 3/1990 Chaney .
5,138,785 * 8/1992 Paterson .
5,241,770 * 9/1993 Lambert .
5,491,918 * 2/1996 Elmstedt .
5,664,358 * 9/1997 Haber et al. .
5,699,687 * 12/1997 Pittman .

* cited by examiner

*Primary Examiner*—Michael J. Carone
*Assistant Examiner*—Troy Chambers
(74) *Attorney, Agent, or Firm*—Edgar W. Averill, Jr.

(57) ABSTRACT

A universal gun lock for insertion into barrel of a gun. The gun lock has a shaft assembly which is inserted into the muzzle end of a bore of the barrel. The lock assembly is held on the external end and the internal end extends into the chamber. An expandable locking cup is expanded by retracting an inner shaft. The locking cup moves outwardly far enough so that it abuts the shoulder of the chamber and cannot be pulled out. A center shaft is extended causing the locking cup to ride down a ramp and contract so that it may be pulled out of the barrel. Preferably, the lock assembly and an inner and outer shaft are provided with a selection of locking ramps and expandable locking cups so that a gun dealer needs only have one lock and shaft assembly with various locking ramps and expandable cups for different sizes of guns. The present invention also includes the process of using the universal lock.

11 Claims, 2 Drawing Sheets

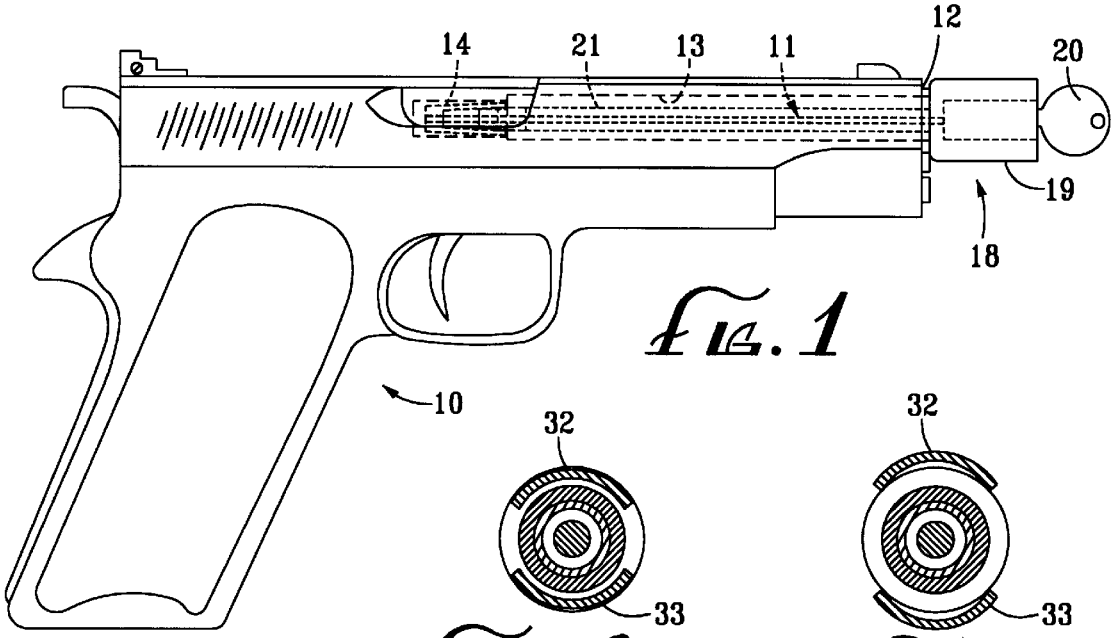
FIG. 1
FIG. 6
FIG. 7
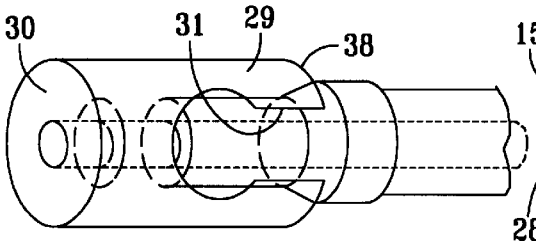
FIG. 2
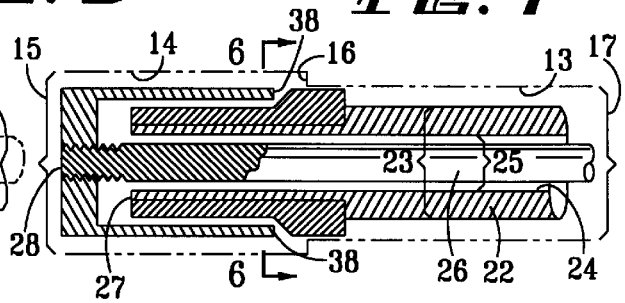
FIG. 3
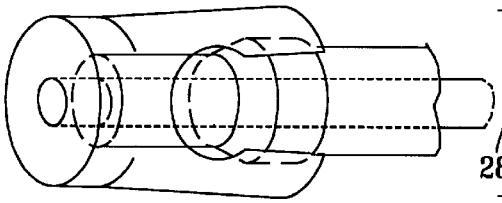
FIG. 4
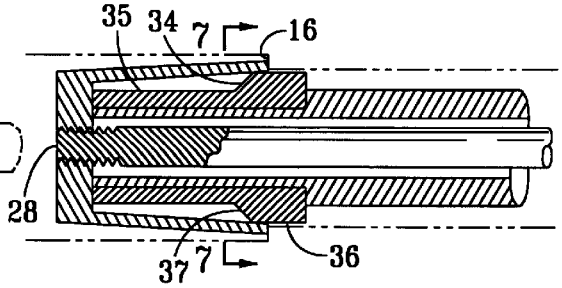
FIG. 5

UNIVERSAL GUN LOCK INSERTED THROUGH MUZZLE

BACKGROUND OF THE INVENTION

The field of the invention is gun locks and the invention relates more particularly to gun locks for handguns of the type which are inserted in through the muzzle of the gun, extend into the chamber and expand. When expanded, the lock cannot be pulled out of the chamber. Gun locks have been available for many years to help reduce the unauthorized use of a handgun.

A gun lock of the general type as the present gun lock is shown in U.S. Pat. No. 2,479,107. A shaft is inserted into the muzzle of a revolver and when the key is turned, a locking pin is projected and contacts a shoulder in the chamber so that the lock cannot be removed while the locking pin is projected.

U.S. Pat. No. 4,512,099 shows a similar style of lock where the expandable portion has a diagonally split sleeve.

U.S. Pat. No. 5,138,785 has a split shaft with a center cam which expands the shaft outwardly, thereby holding it in the chamber.

U.S. Pat. No. 5,289,653 also utilizes a cam expanded outer sleeve together with a spring loaded adapter which permits the device to be used on guns of different barrel lengths.

U.S. Pat. No. 5,664,358 shows another style of expandable outer sleeve.

A problem with most prior art gun locks is that the gun lock is useful only for a particular gun. A gun dealer would have to stock a large and expensive inventory of gun locks to be prepared to provide a gun lock for the typical wide selection of hand guns available. Not only do barrel lengths differ, but also the bore size differs as does the chamber size.

BRIEF SUMMARY OF THE INVENTION

It is an object of the present invention to provide a universal gun lock which permits a universal locking portion to be connected with a relatively inexpensive set of ramps and expandable caps to permit the lock to be adapted to fit many sizes of handguns.

The present invention is for a gun lock for insertion in the barrel of a gun, said gun lock being of the type having a shaft assembly insertable into a muzzle end of a bore. A lock assembly has a housing which surrounds a lock which moves an inner locking shaft in and out with respect to the housing. A hollow outer shaft is fixed to the housing of the lock assembly and has an outside diameter which fits within the bore. An inner locking shaft is held within the hollow outer shaft and the inner locking shaft extends and retracts as the lock moves between the locked position and the unlocked position. A locking ramp is held by the hollow outer shaft and positioned inwardly from the chamber end of the hollow outer shaft. The locking ramp has a reduced diameter length and an expanded diameter length with a ramp between the two portions. An expandable locking cup is held to the locking shaft. The locking cup has a wall portion with slotted sides which are positioned over the reduced diameter length of the locking ramp when in an unlocked configuration and when the locking shaft is retracted, the fingers move along the ramp to a position where they extend over the expanded diameter length and thereby abut a shoulder of the chamber preventing the lock from being removed when it is in the locked position. When the lock is provided to a gun shop, it can be provided with a universal portion which includes the lock housing, hollow outer shaft and inner locking shaft. Then a selection of locking ramps are provided separately together with a selection of expandable locking cups. The process of utilizing the universal gun lock includes the steps of selecting a locking ramp having a bore contacting portion with an outside diameter slightly smaller than the bore inside diameter and affixing the selected locking ramp to the chamber end of the hollow outer shaft. Next, an expandable locking cup is selected which has an outside diameter about equal to the outside diameter of the bore contacting portion of the locking ramp and affixing the expandable locking cup to the chamber end of the inner locking shaft. The process may also include the further step of selecting a barrel spacer having an inner passageway larger than the hollow outer shaft and smaller than the housing of the lock assembly, and a length equal to the difference between the bore length and the distance between the lock assembly housing and an inner end of said expandable locking cup. When the expandable locking cup is in a locked configuration, the barrel spacer permits the universal lock to be utilized with different barrel lengths.

BRIEF DESCRIPTION OF THE DRAWINGS

FIG. 1 is a side view of a handgun with the gun lock of the present invention installed thereon.

FIG. 2 is an enlarged perspective view of the chamber of the portion of the gun lock of FIG. 1.

FIG. 3 is a cross-sectional view of the chamber end of the gun lock of FIG. 1.

FIG. 4 is a perspective view of the chamber end of the gun lock of FIG. 1 in a locked configuration.

FIG. 5 is a cross-sectional view of the chamber end of the gun lock of FIG. 4.

FIG. 6 is a cross-sectional view taken along line 6—6 of FIG. 3.

FIG. 7 is a cross-sectional view taken along line 7—7 of FIG. 5.

DESCRIPTION OF THE PREFERRED EMBODIMENTS

Figure 8:
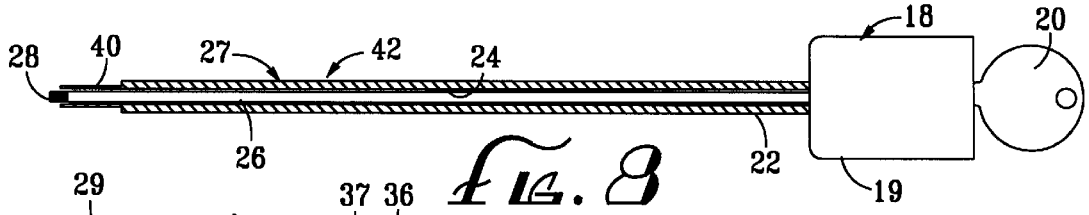
FIG. 8 is a side view partly in cross-section of the housing, hollow outer shaft and inner locking shaft of the gun lock of FIG. 1.

A handgun 10 is shown in side view in FIG. 1 including the gun lock 11 of the present invention. Gun 10 has a muzzle end 12, a bore 13 and a chamber 14. The chamber is shown in phantom view in FIGS. 3 and 5. There it can be seen that chamber 14 has a chamber inside diameter 15 and a shoulder 16 between the chamber and bore 13. Bore 13 has a bore inside diameter 17.

The gun lock 11 of FIG. 1 has a lock assembly 18 with a housing 19 and a key 20. While a key operated lock is shown, a combination or other style lock can be used. A shaft assembly 21 is held to the housing and, as shown in FIGS. 3 and 5, has a hollow outer shaft 22 having a hollow outer shaft outside diameter 23. Hollow outer shaft 22 has an inner passageway 24 with a passageway inside diameter 25. An inner locking shaft 26 fits within inner passageway 24 and moves back and forth as key 20 is turned which can be seen by comparing FIG. 3 with FIG. 5. Hollow outer shaft 22 has a chamber end 27, and inner locking shaft 26 has a chamber end 28.

An expandable locking cup 29 has a base 30 which is affixed to the chamber end 28 of inner locking shaft 26. Expandable locking cup 29 has a pair of slots 31 which create two locking fingers 32 and 33. While two slots 31 are shown, it is, of course, contemplated that three or four slots could also be used to provide a greater number of locking fingers.

A locking ramp 34 is affixed to the chamber end 27 of hollow outer shaft 22. Locking ramp 34 has a reduced diameter length 35 and an expanded diameter length 36. A camming surface 37 extends between reduced diameter length 35 and the expanded diameter length 36. As shown by comparing FIGS. 3 and 5, the inner ends 38 of locking fingers 32 and 33 ride up the camming surface 37 and expand outwardly so that they contact shoulder 16. This, of course, prevents the lock from being removed. Locking fingers 32 and 33 are flexible and return to their original retracted position when moved back to an unlocked position.

The use of a locking ramp and expandable cup, which may be selectively affixed to shaft assembly 21, provides a substantial advantage for a gunsmith. The shaft assembly 21, including lock assembly 18, hollow outer shaft 22 and inner locking shaft 26, provides the more expensive portion of the gun lock of the present invention. By providing a selection of different sizes of locking ramps and expandable locking cups which can be affixed to shaft assembly 21, the gunsmith is permitted to have a far less expensive inventory of locks while still being able to provide gun locks for a wide variety of sizes of handguns. While the term "handgun" has been used herein, it is, of course, to be understood that the lock assembly of the present invention can be used on rifles, shotguns and guns of various sizes.

Figure 9:
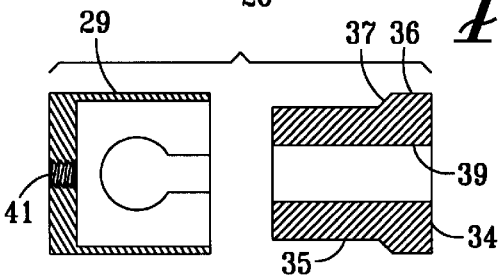
FIG. 9 is a cross-sectional view of a locking ramp and expandable locking cup useful with the locking assembly of FIG. 8.

A locking ramp 34 of a first size is shown in FIG. 9 and has a bore contacting portion or expanded diameter length 36, a ramp or camming portion 37 and a cup surrounded portion or reduced diameter length 35. An inner passageway 39 fits snugly over a locking ramp affixment shaft 40, shown in FIG. 8, and is preferably connected by use of an adhesive. This could, of course, also be threaded. An expandable locking cup 29 is selected, which has an outside diameter about equal to the expanded diameter length 36 of locking ramp 34. Expandable locking cup 29 has a threaded portion 41 which screws onto the threaded portion 42 of inner locking shaft 26. Thus, once the gun bore size has been determined, the locking ramp is affixed to the hollow outer shaft 22. Next, the expandable locking cup 29 is screwed onto the end of inner locking shaft 26. Preferably, an adhesive or thread lock is used in this step also to secure the expandable locking cup to the inner locking shaft 26.

Figure 10:
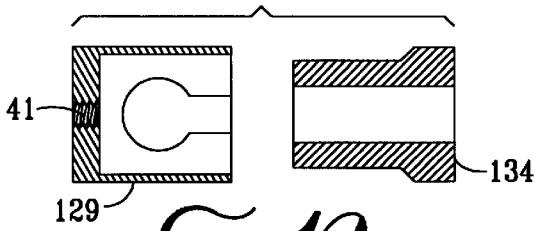
FIG. 10 is a cross-sectional view of a smaller locking ramp and smaller expandable locking cup than that of FIG. 9 useful with the assembly of FIG. 8.
Figure 11:
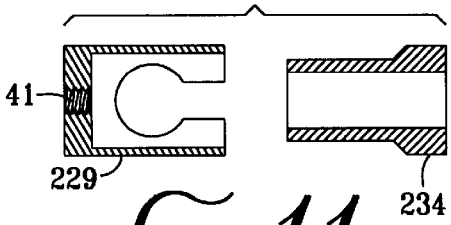
FIG. 11 is a cross-sectional view of a still smaller locking ramp and expandable locking cup useful with the assembly of FIG. 8.

FIG. 10 shows a slightly smaller size of locking ramp 134 and expandable locking cup 129 which would be affixed to the universal lock piece 42 shown in FIG. 8. A still smaller size of expandable locking cup 229 and locking ramp 234 are shown in FIG. 11 and are used for still smaller bores.

Figure 12:
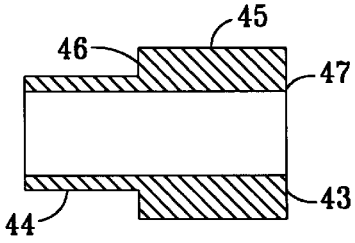
FIG. 12 is a cross-sectional view of a barrel spacer useful with the assembly of FIG. 8.
Figure 13:
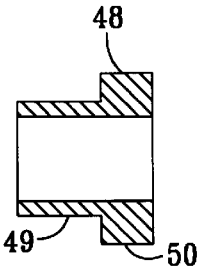
FIG. 13 is a cross-sectional view of a smaller barrel assembly useful with the assembly of FIG. 8.

A barrel spacer 43 is shown in FIG. 12. Barrel spacer 43 has a smaller outside diameter portion 44 which fits snugly within the muzzle of the gun. Barrel spacer 43 also has a larger portion 45 which creates a shoulder 46 which abuts the muzzle of the gun. The outer end 47 abuts the housing 19 and the length of the larger portion of the spacer is selected so that it has a length equal to the distance between the bore length and the distance between the lock assembly housing and an inner end of the expandable locking cup when the expandable cup is in a locked configuration. A shorter barrel spacer 48 is shown in FIG. 13 and has a smaller portion 49 and a larger portion 50. Various barrel spacers can be provided to permit the universal gun lock piece 42 to be used with different sizes of guns.

Figure 14:
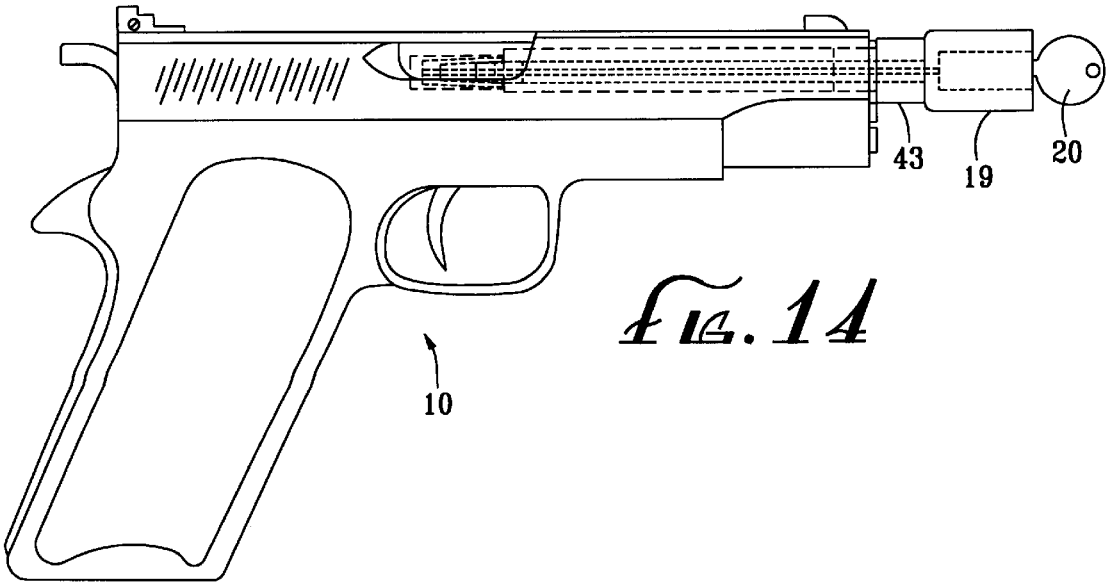
FIG. 14 is a cross-sectional view of the lock, locking cup and locking ramp of the present invention installed in a handgun.

An assembled lock including a barrel spacer is shown on a gun in FIG. 14 which provides an easily installed and removed lock, all providing a high level of security when the key is removed.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A gun lock for insertion in a barrel of a gun, said gun lock being of the type having a shaft assembly insertable into a muzzle end of a bore of the barrel, said bore having an inside diameter and said gun having a chamber inside diameter larger than said bore inside diameter and a shoulder between said chamber and said bore, said gun lock comprising:

a lock assembly having a housing which surrounds a lock and said lock assembly including means to move an inner locking shaft in and out with respect to said housing when said lock is moved between a locked position and an unlocked position;

a shaft assembly comprising:

a hollow outer shaft fixed at a lock end to said housing of said lock assembly, said hollow outer shaft having a shaft outside diameter less than said bore inside diameter so that it fits easily into said bore, said hollow outer shaft having an inner passageway with a passageway inside diameter and said hollow outer shaft having a chamber end;

an inner locking shaft held within said hollow outer shaft, said inner locking shaft having a lock end and a chamber end, said inner locking shaft extending and retracting as said lock moves between a locked position and an unlocked position;

a locking ramp held by said hollow outer shaft and positioned inwardly from the chamber end of said hollow outer shaft, said locking ramp extending from a reduced diameter length adjacent said chamber end of said hollow outer shaft and an expanded diameter length positioned further from said chamber end of said hollow outer shaft than said reduced diameter length, said locking ramp having a camming surface; and an expandable locking cup having a base affixed to the chamber end of said locking shaft and slotted sides forming at least two locking fingers each having an outer end, said locking fingers being movable from an unlocked/extended position to a locked/retracted position as said lock moves between a unlocked position and a locked position and the outer end of said locking fingers moves from a position over said reduced diameter length in an unlocked position and as the inner locking shaft retracts, the outer end of each locking finger rides along said camming surface to a position over said expanded diameter length in a locked position and each outer end moves outwardly so that it faces said shoulder of said chamber so that the shaft assembly cannot be removed from the barrel of said gun.

2. The gun lock of claim 1 wherein said reduced diameter length of said locking ramp and said expanded diameter length is formed on a separate locking ramp piece affixed to the chamber end of said hollow outer shaft.

3. The gun lock of claim 1 wherein said expandable locking cup is a separate cup piece affixed to the chamber end of said inner locking shaft.

4. The gun lock of claim 1 wherein both said reduced diameter length of said locking ramp and said expanded diameter length are formed on a separate locking ramp piece affixed to the chamber end of said hollow outer shaft and said expandable locking cup is a separate cup piece affixed to the chamber end of said inner locking shaft.

5. The gun lock of claim 4 wherein said locking ramp piece is threadably affixed to said inner locking shaft.

6. The gun lock of claim 4 wherein said cup piece is affixed by an adhesive along an inner length of said cup piece and an outer length of said hollow outer shaft.

7. The gun lock of claim 1 further including a barrel spacer having an inside diameter larger than said outside diameter of said hollow outer shaft and a stepped outside diameter having a larger portion having an outside diameter greater than said inside diameter of said bore and having a smaller portion having an outside diameter slightly smaller than the inside diameter of said bore.

8. A process of assembling a gun lock for a particular gun having a particular bore inside diameter, a particular chamber size, and a particular bore length utilizing a universal gun lock piece having a lock assembly having a housing which surrounds a lock and said lock assembly including means to move an inner locking shaft in and out with respect to said housing when said lock is moved between a locked position and an unlocked position, a shaft assembly having a hollow outer shaft fixed at a lock end to said housing of said lock assembly, said hollow outer shaft having a shaft outside diameter less than said bore inside diameter so that it fits easily into said bore, said hollow outer shaft having an inner passageway with a passageway inside diameter and said hollow outer shaft having a chamber end, and an inner locking shaft held within said hollow outer shaft, said inner locking shaft having a lock end and a chamber end, said inner locking shaft extending and retracting as said lock moves between an unlocked position and a locked position, said process comprising:

selecting a locking ramp comprising a selected locking ramp having a bore contacting portion with an outside diameter slightly smaller than said bore inside diameter;

affixing said selected locking ramp to the chamber end of said hollow outer shaft;

selecting an expandable locking cup having an outside diameter about equal to the outside diameter of said locking ramp; and affixing said expandable locking cup to said chamber end of said inner locking shaft to create a gun lock to fit a particular gun.

9. The process of claim 8 further including the steps of:

selecting a barrel spacer having an inner passageway larger than said hollow outer shaft and smaller than an outside diameter of said housing of said lock assembly said barrel spacer having a spacer length equal to the difference between the bore length and the distance between the lock assembly housing and an inner end of said expandable locking cup when said expandable locking cup is in a locked configuration; and placing said barrel spacer over said hollow outer shaft and sliding said barrel spacer into contact with said housing of said lock assembly.

10. The process of claim 8 wherein an adhesive is applied between said locking ramp and said hollow outer shaft prior to affixing said locking ramp to said hollow outer shaft.

11. The process of claim 8 wherein said expandable locking cup is screwed onto said inner locking shaft.

* * * * *